US005337951A

United States Patent [19]

Roccaforte

[11] Patent Number: 5,337,951

[45] Date of Patent: Aug. 16, 1994

[54] STURDY SANDWICH CARTON

[75] Inventor: Harry I. Roccaforte, Chicago, Ill.

[73] Assignee: Waldorf Corporation, St. Paul, Minn.

[21] Appl. No.: 925,608

[22] Filed: Aug. 5, 1992

[51] Int. Cl.[5] ..... B65D 5/24

[52] U.S. Cl. ..... 229/186; 229/102; 229/150

[58] Field of Search ..... 229/114, 149, 150, 152, 229/102, 40, 186

[56] References Cited

U.S. PATENT DOCUMENTS

| | | | |
|---|---|---|---|
| Re. 32,956 | 6/1989 | Schuster . | |
| 413,784 | 10/1889 | Hotchkiss . | |
| 2,781,159 | 2/1957 | Copeman . | |
| 2,800,268 | 7/1957 | Mathews . | |
| 2,944,295 | 7/1960 | Sloan . | |
| 2,956,720 | 10/1960 | Rindal . | |
| 3,000,275 | 9/1961 | Sevison . | |
| 3,146,933 | 9/1964 | Moore . | |
| 3,454,209 | 7/1969 | Persson . | |
| 3,782,071 | 1/1974 | Hagedorn . | |
| 4,003,515 | 1/1977 | Steele | 229/150 X |
| 4,171,763 | 10/1979 | Card | 229/150 X |
| 4,199,097 | 4/1980 | Christensson | 229/186 X |
| 4,295,839 | 10/1981 | Baker et al. . | |
| 4,447,004 | 5/1984 | House et al. . | |
| 4,451,001 | 5/1984 | Webinger | 229/186 X |
| 4,472,896 | 9/1984 | Brauner et al. . | |
| 4,575,000 | 3/1986 | Gordon et al. . | |
| 4,830,270 | 5/1989 | Holmes | 229/150 X |
| 4,836,439 | 6/1989 | Hart . | |
| 4,925,019 | 5/1990 | Ganz et al. | 229/40 X |
| 4,930,639 | 6/1990 | Rigby | 229/186 X |
| 4,951,868 | 8/1990 | Mode . | |
| 5,033,668 | 7/1991 | Cohen et al. . | |
| 5,125,565 | 6/1992 | Rogers | 229/150 X |
| 5,183,201 | 2/1993 | Gulliver | 229/186 X |

*Primary Examiner*—Gary E. Elkins
*Assistant Examiner*—Christopher McDonald
*Attorney, Agent, or Firm*—Dorsey & Whitney

[57] ABSTRACT

A carton for fast food items is provided. The carton has a polygonal bottom panel with four generally rectangular side wall panels foldably attached to the edges thereof. A major top closure panel is foldably connected to one of the side wall panels, and a minor top closure panel is foldably connected to the opposite side wall panel. The minor top closure panel carries a closure tab having bilateral locking wings. A slot is provided in the major top closure panel for receiving the closure tab. The carton includes corner closing, back-folded, double layer webs at each corner. Each web is foldably connected to a first associated side wall panel at a perforated fold scoreline collinear with the edge of that panel, and to an adjacent side wall panel along an angled perforated or cut fold scoreline extending outwardly at approximately 45° from each corner of the bottom wall panel. The present invention also encompasses a die cut blank for forming the carton.

The present invention also includes a forming fixture for erecting the carton at the point of use. The forming fixture has a base and two pairs of forming walls, each wall angling upwardly and outwardly from the base, one pair of walls being disposed at an angle of approximately 45° to the base, while the other pair of walls is at approximately a 60° angle.

13 Claims, 12 Drawing Sheets

STURDY SANDWICH CARTON

BACKGROUND OF THE INVENTION

1. Field of the Invention

The present invention relates to paperboard cartons. More particularly, the present invention relates to a paperboard carton or container for fast food items, the blank for forming the carton, and a point of use forming fixture for facilitating the erection and filling of cartons at the point of use. The invention also relates to the method of using the fixture.

2. Description of the Prior Art

In recent years, there has been a proliferation of fast food restaurants. Typically, the food items sold at such restaurants include individually packaged hamburgers or other sandwiches, which are unwrapped or opened by the consumer upon purchase. A number of containers have been used for this purpose, ranging from polystyrene clamshell type cartons to simple paper wrapping.

Even more recently than the rise of the popularity of convenience or fast food restaurants, there has been increased recognition of the need to conserve natural resources. Thus, there is pressure upon the paper and paperboard packaging industries to increase the efficient use of stock material and to use recyclable material for disposable packages or cartons. Rising prices are also driving the quest for efficiency and economy.

These demands, and the need to provide an attractive, sturdy package or carton for consumer goods, including fast food items, have created the need for a sturdy, simple recyclable or disposable carton for packaging such food items that can be cost efficiently manufactured, rapidly and easily erected and filled at the point of use, closed and locked to adequately protect the contents, and easily opened by the consumer.

Although commercially available food item cartons, and methods of forming the cartons, have improved, there are some problems which have remained unaddressed. A principal problem is providing a carton, and blank therefor, which minimizes the use of valuable resources while at the same time maintaining the food items in as clean and secure a condition as possible after the purchase thereof and prior to consumption. Handling of some commercially available packages, such as a simple paper wrapping, can dislodge the food item from its container, thus contaminating it. It is highly desireable that a food item package or carton be strong enough to adequately protect the contents, yet be easy to open. It is also desireable that a container or carton for fast food items be quickly and easily erected and filled at the point of use. With current packaging methods, ease of use, efficient manufacture and safety are not enhanced to an optimum degree.

U.S. Pat. No. 2,781,159 (to Copeman) discloses a moisture impervious container for protecting the contents. The Copeman container discloses scorelines around the edges of the side wall panels, whereby the peripheral edge portions of two sidewall panels automatically fold flatly against corresponding edge portions of the other two sidewall panels. This structure is directed to providing a rigid corner construction and hermetic seal. The carton of the Copeman patent is not specifically directed to containing food items and does not disclose a carton which is easily opened and closed. Rather, the top wall panel of the carton simply overlies the upper edge portions of the side walls and includes an extreme end flap that is joined to one of the side wall panels when the carton is closed.

U.S. Pat. No. 2,956,720 (to Rindal) discloses a locking structure including a male locking member having an arrow-like configuration and a slit line female locking member for receiving the male locking member. U.S. Pat. No. 4,472,896 (to Brauner et al.) discloses a carton for food products such as hamburgers. The carton is one of the aforementioned clamshell type cartons and includes a locking tab and slit arrangement for dosing the carton.

None of the above-noted patents discloses a fixture or folding apparatus for facilitating the erection of a carton at the point of use. U.S. Pat. Nos. 3,000,275 (to Sevison), 3,146,933 (to Moore), 3,782,071 (to Hagedorn) and 4,295,839 (to Baker et al.) disclose methods and apparatus for forming cartons or trays. The Moore patent discloses a carton having flanges to reinforce the corners. The flanges are hinged to each other on diagonal foldlines extending obliquely from the corners. The apparatus for forming the blank into the shaped carton is a female die wherein the sidewalls of the carton are angled upwardly as the carton blank is forced into the female die. Somewhat similarly, the Baker et al. patent discloses a tray forming apparatus that includes a forming head with a cavity for causing the tray side walls to be erected and the tray gusset corners to be flat against adjacent side walls.

The Sevison patent, particularly FIGS. 16 and 17, and the Hagedorn patent, particularly FIG. 8, disclose that the end or side wails of a blank may be successively folded to positions at right angles to the bottom wall. With specific regard to the Sevison patent, the carton end walls first ride over a first curved edge portion of a jig whereby they move upwardly to a position substantially perpendicular to the bottom wall of the blank. Thereafter, the side walls of the box or carton ride over another curved edge portion of the jig to affect folding.

While the immediately preceding four patents provide useful apparatus for forming a carton, in each case the forming apparatus is part of a large, complex machine which is unsuitable for use in a fast food restaurant, or in any restaurant environment. Additionally, none of the above-noted patents discloses a forming or erecting fixture wherein the forming faces of the fixture walls are at specific angles to induce folding of the wall panels of a carton blank in a specific order or sequence, or a recess or slot between adjacent fixture walls to accommodate a carton that includes backfolded webs or gussets.

Accordingly, there is a need for a sturdy, simple, cost efficient, disposable carton for containing fast food items, and for a forming fixture which may be conveniently used in a restaurant in the food service industry to facilitate the erecting, filling and closing of the carton prior to sale of a food item to the consumer.

SUMMARY OF THE INVENTION

In accordance with the present invention, a carton for consumer items, particularly fast food items, is provided. The carton comprises a generally rectangular and substantially lockable carton having a polygonal bottom panel with four generally rectangular side wall panels foldably attached to the edges thereof. A major top closure panel is foldably connected to the upper free edge of one of the side wall panels, and a minor top closure panel is foldably connected to the upper free edge of the opposite side wall panel. The minor top closure panel has a free edge with a generally central relieved area and a closure tab, having bilateral locking wings, is foldably connected in the generally central region of the relieved area. An opening is provided in the major top closure panel for receiving the closure tab. Between each pair of opposed side wall panels, i.e., at each corner of the erected carton, the carton includes corner closing means. The corner closing means comprises a back folded, double layer web at each corner. Each web is foldably connected to the associated side wall panels at a perforated fold scoreline collinear with the side edges of two panels, and is connected to the adjacent side wall panels along an angled, perforated or cut fold scoreline extending outwardly at approximately 45° from each corner of the bottom wall panel. The present invention also encompasses a die cut blank for forming the carton.

The present invention also includes a forming fixture for erecting and filling the carton at the point of use, typically a fast food restaurant. The forming fixture comprises a base member with raised curb plate supports fixedly mounted thereon. Four angled forming walls, arranged in two opposed and generally similar pairs, each pair being comprised of two similarly angled forming walls, are attached to a curb plate fixed to the curb plate supports. Each forming wall has an inside forming face, a bottom edge, a top edge, and two opposed side edges. The four walls define an open, central, carton bottom receiving cavity. Each wall tapers or angles upwardly and outwardly from the base, and the forming faces of one pair of walls are disposed at an angle of approximately 45° with respect to the base, while the forming faces of the other pair of forming walls are at approximately a 60° angle. At each corner of the receiving cavity, the curb is provided with a backfold web receiving slot. Each slot extends outwardly from the cavity toward the periphery of the base, along the sides of the 60° forming walls.

One feature of the carton of the present invention is a double thickness corner backfold web at each corner of the carton of the present invention in combination with a closure means and locking means. A web panel is at each end of two of the side panels. The webs are foldably connected to the associated side wall panel at a fold line which is parallel to the free edge of the webs and which is coincident or collinear with the edge of that side wall panel when the carton is erected. The backfold webs are connected to the other two side walls of the carton along an angled cut scoreline that extends outwardly from each corner of the bottom panel. This feature makes the carton of the present invention very sturdy when erected and suitable for use for relatively heavy food items such as hamburgers. Even if the package rotated on its side by a consumer or a restaurant worker, the sandwich will not push any of the side walls outwardly.

A further feature of the present invention is an improved lock means for a food carton.

Accordingly, it is an object of the present invention is to provide a sturdy, yet easily erected, filled, locked and opened carton for containing fast food items.

Another object of the present invention is to provide a package or carton for food items whereby, during handling of the carton, damage to the contents is minimized.

Yet another object of the present invention is to provide a forming fixture or jig for erecting and filling the carton at the point of use.

A further object of the present invention is to provide a simple, cost efficient paperboard carton for containing a food item whereby the carton protects the food item during vending, yet may be rapidly and easily erected and filled at the point of use, and wherein typical manufacturing operations may be used to form the blank for the carton.

Still another object of the present invention is to provide a carton for containing food items which may be erected rapidly and easily, closed and locked for distribution to consumers, yet may be opened easily by the consumer and used as a tray for supporting a food item during its consumption.

In use, the blank for forming the carton of the present invention is die-cut and may be shipped, partially glued or flat, to the point of use. The carton of the present invention is erected and filled at the point of use by placing the flat blank, exterior down, on top of the forming fixture with the bottom panel aligned with the cavity of the fixture and with the carton side wall panels having the backfold webs aligned over the 60° forming faces of the fixture. A sandwich or other food item is placed on top of the bottom panel and the weight of the sandwich will begin to force the bottom panel into the cavity. As the carton, specifically the bottom wall panel, is pushed further into the cavity of the forming fixture, the 60° forming faces cause the side wall panels with the backfold web panels to start to fold inwardly before the other pair of side wall panels. The backfold web panels, connected to the other, second pair of side walls along the angled cut, fold inwardly as the first folded side wall panels approach vertical, becoming parallel to the second pair of side walls and forming the corner closing webs. When the carton bottom is in contact with the base of the fixture, the backfold corner webs automatically lock the side panels in place and dose the corners of the carton. The open top of the carton is closed by folding the major and minor top closure flaps toward each other into overlaid relation and inserting the locking tab into the tab receiving slot, lifting the tip of the tab until the wings are out.

An important advantage of the present invention is that it combines specific package manufacturing and shipping advantages, such as cost efficient production and shipment in a flattened state, with specific point of use advantages, such as adequate protection of the contents, enhanced strength, and easy opening. The carton of the present invention may be used with suitable supplemental packaging means such as thermoplastic shrinkwrap or other wrappings, either inside or outside the carton walls.

Even though the carton of the present invention adequately protects a food item during handling or distribution thereof, it provides for easy opening at the point of use. The carton, particularly the blank therefor, may be adapted easily to reconfigure the carton to accommodate various food items or consumer goods and different sizes of food items.

Other advantages of the present invention include the ability of the packages to be erected or formed during the process of placing the contents in the carton, and the ability to easily lock or seal the carton after filling. The carton of the present invention eliminates the shipment of voids which are prevalent when dealing with the widely used clamshell type cartons.

Other objects and advantages of the present invention will become more fully apparent and understood with reference to the following specification and to the appended drawings and claims.

DETAILED DESCRIPTION OF THE PREFERRED EMBODIMENT

Figure 1:
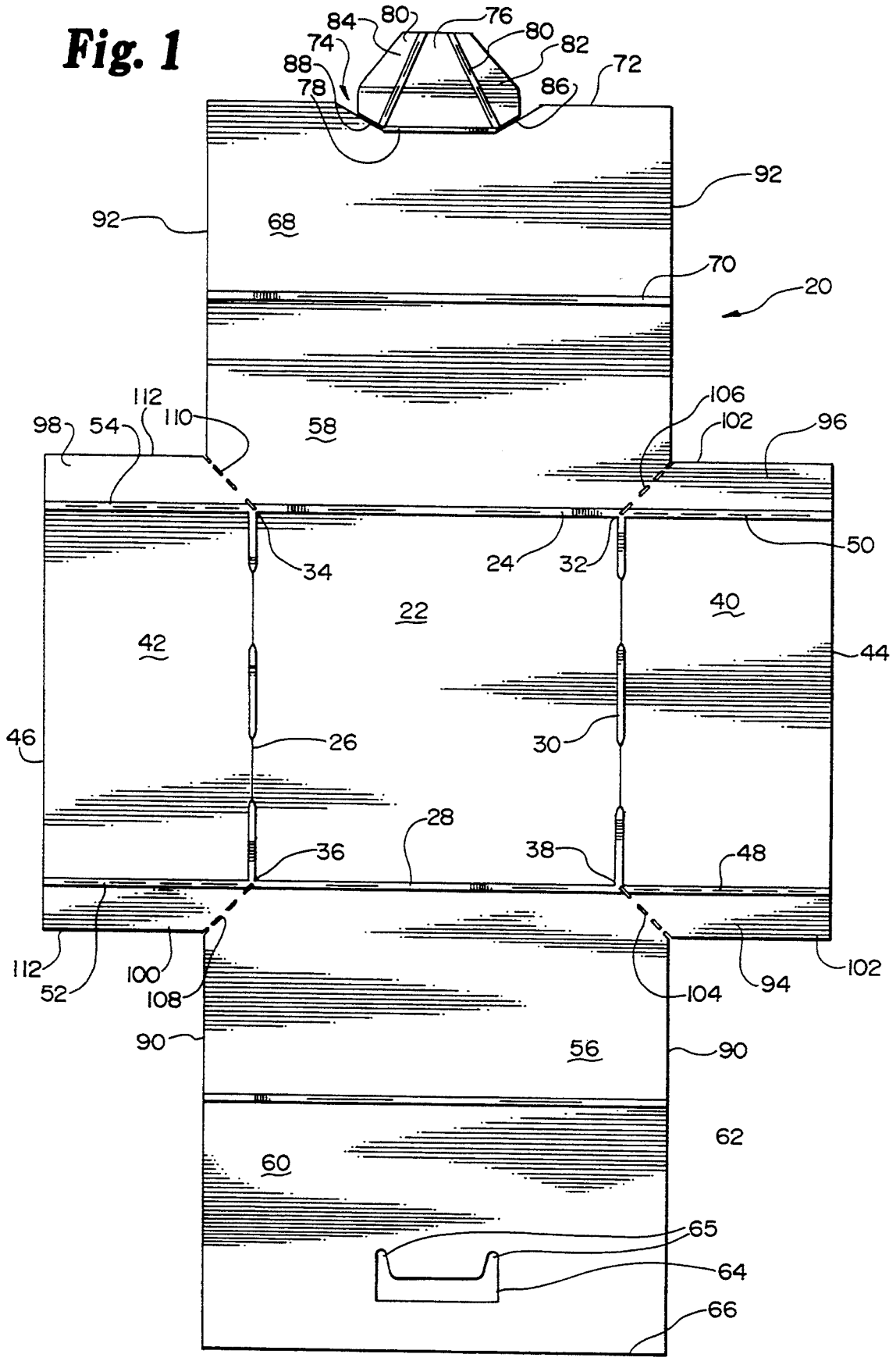
FIG. 1 is a top plan view depicting the inside and profile of the die-cut blank for forming the carton of the present invention, prior to erection.

As shown in FIG. 1, a blank 20 in accordance with the present invention is formed by a predetermined pattern of fold scorelines, perforated or cut fold scorelines, and cuts, scores and free edges. In the drawings, double lines indicate fold scorelines and single solid or single dashed lines indicate cuts, scores or free edges.

The blank 20 has a polygonal, square bottom wall panel 22 formed and defined by cut fold scorelines 24, 26, 28, 30. The foldlines 24, 28 are opposed and parallel with respect to each other, and are generally perpendicular to the parallel bottom wall panel edge foldlines 26, 30. The intersection of the foldlines 24, 26, 28, 30 form the periphery of the bottom wall panel 22 and also form bottom wall panel corners 32, 34, 36, 38.

The blank 20 includes a first pair of side wall panels, including side wall panel 40 and side wall panel 42, foldably or hingedly connected to the bottom panel 22 at foldlines 30, 26, respectively. The side wall panels 40, 42 have a free edge 44, 46, respectively, parallel to the foldlines 30, 26 at which they are attached to the bottom panel 22. The sides of the side wall panel 40 are formed by foldlines 48, 50 which are collinear with the foldlines 28, 24, respectively, forming two of the four side edges of the bottom panel 22. Similarly, the sides of the side wall panel 42 are defined by foldlines 52, 54 which are collinear with bottom panel edge foldlines 28, 24, respectively.

The blank 20 for forming the carton of the present invention includes another, second pair of generally rectangular side wall forming panels, including side wall panel 56 and side wall panel 58. The side wall panels 56, 58 are connected to the bottom panel 22 along foldlines 28, 24, respectively. A first outer, overlapping cover forming panel 60 is foldably connected to the side wall panel 56 at a fold scoreline 62. The cover forming panel 60 includes a tab receiving opening 64 adjacent its free edge or end 66. The opening 64 has expanded ends 65.

An inside or underlying cover forming panel 68 is foldably connected to the side wall 58 at a foldline 70. The free edge 72 of the cover forming panel 68 includes a generally central relieved area 74. A generally triangular closure tab 76 is foldably connected to the cover forming panel 68 along a connection foldline 78 in the generally central region of the relieved area 74. The closure tab 76 includes a tab center defined by angular closure fold scorelines 80. A pair of closure tab wings 82, 84 are foldably connected to the closure tab 76 along the foldlines 80. The wings 82, 84 are separated from the cover forming panel 68 by cut slits 86, 88 which join with the foldline 78. The free cut side edges 90 of the side wall panel 56 and outside cover panel 60 are collinear with respect to the free, cut side edges 92 of the side wall panel 58 and the inside cover forming panel 68.

As illustrated, the length of the opening 64 is greater than the length of the scoreline 78 and the width dimensions of the opening 64 in the area of the ends 65 are greater than the maximum width dimension of the wings 82, 84 as measured along a line perpendicular to the foldlines 80. This enables the tab 76 to be easily and quickly inserted into and removed from the opening to closed and open the lock means.

With continued reference to FIG. 1, the side wall panels 40, 42 include backfolding support web panels 94, 96 and 98, 100, respectively. The backfolding support web panels 94, 96 are foldably connected to side wall panel 40 along foldlines 48, 50, respectively, and have an outermost free edge 102 parallel to the foldlines 48, 50. The web panels 94, 96 are foldably connected to the side wall panels 56, 58 at angled cut fold scorelines 104, 106, respectively. The cut lines 104, 106 extend from the corners 38, 32 of the bottom wall panel 22 at approximately a 45° angle. Similarly, the backfolding support web panels 98, 100 are foldably connected to side wall panel 42 along foldlines 54, 52, respectively, and are foldably coupled to side wall panels 56, 58 along angled cut fold scorelines 108, 110 extending from corners 34, 36 at approximately a 45° angle. The backfolding support web panels 98, 100 have free edges 112, parallel to foldlines 52, 54 and collinear with the free edges 102 of the backfolding web support panels 94, 96.

Figure 12:
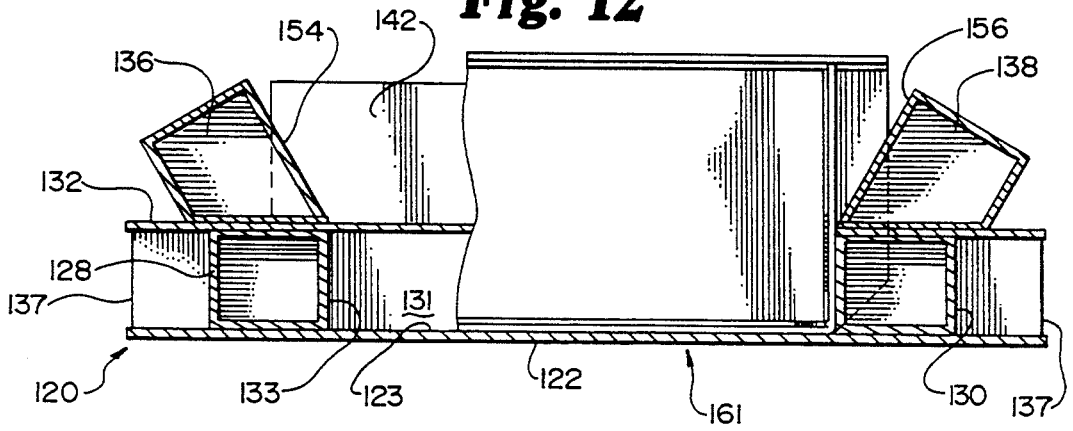
FIG. 12 is a section along line 12—12 of FIG. 11, with a portion broken away.
Figure 11:
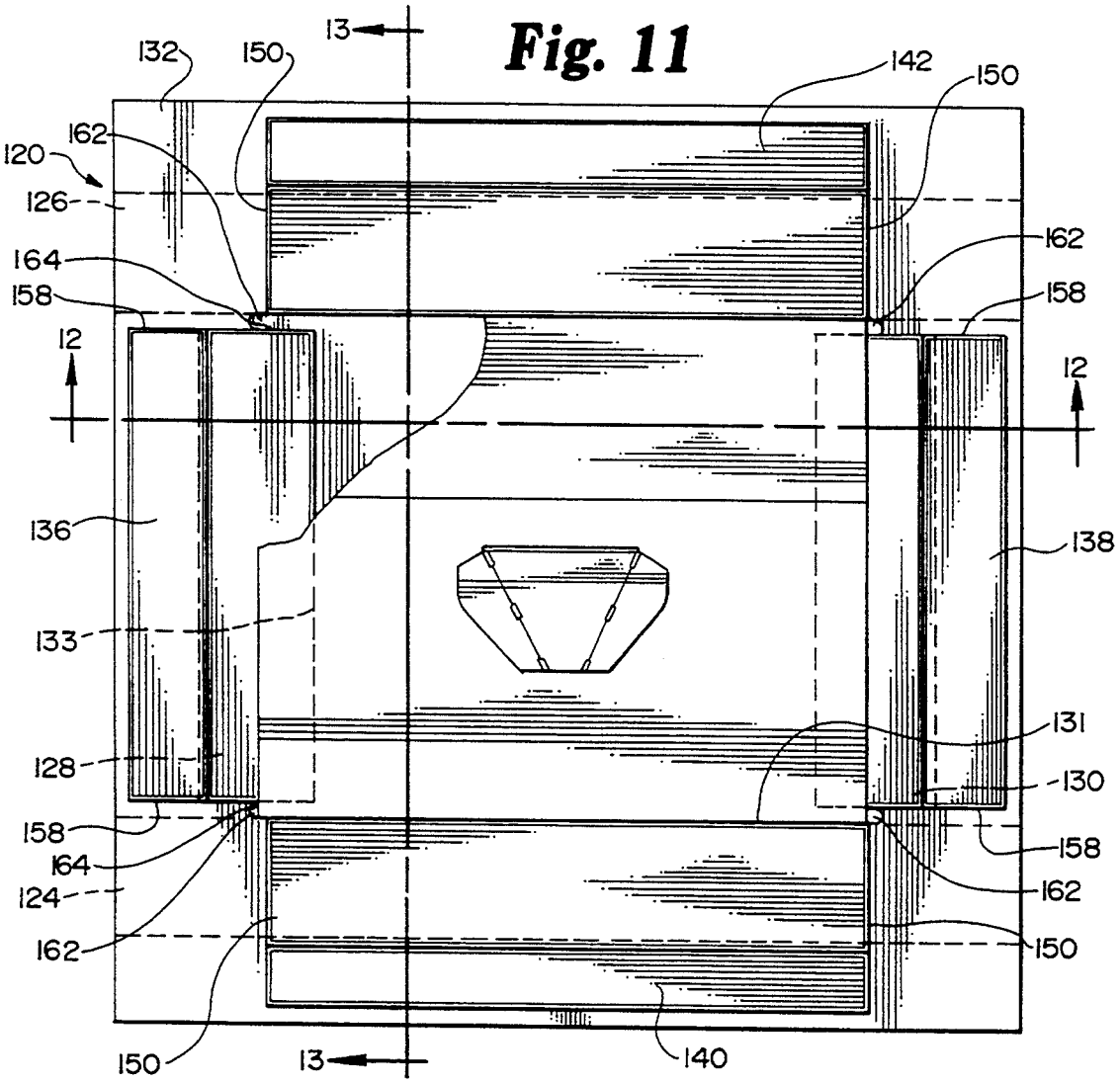
FIG. 11 is a top plan view of the forming fixture of the present invention with an assembled carton position therein.
Figure 13:
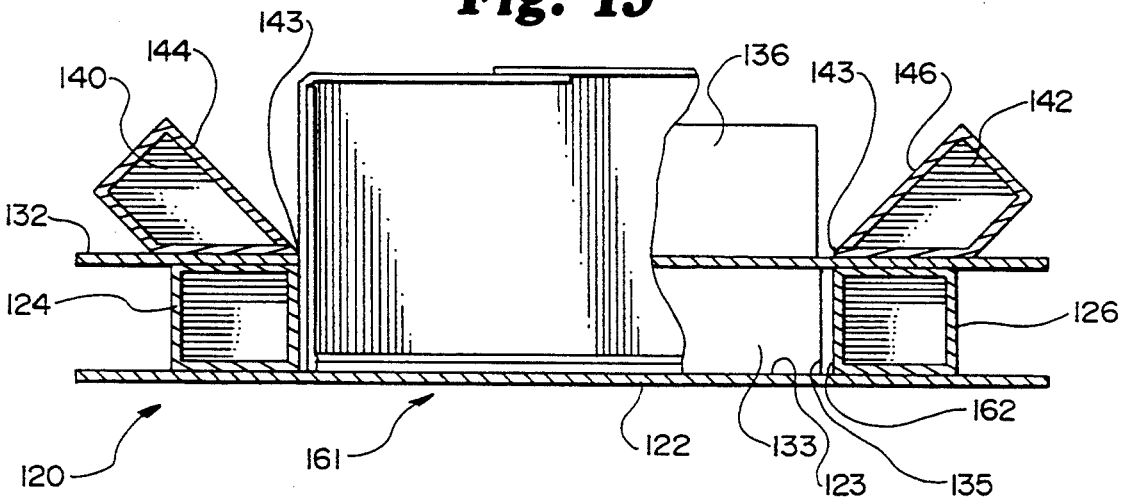
FIG. 13 is a section along line 13—13 of FIG. 11, with a portion broken away.

Referring to FIGS. 11–13, the erecting or forming fixture 120 of the present invention includes a generally flat base 122. The upper surface of the base 122 defines a package support surface 123. Preferably the support surface 123 has a size and configuration approximating the size and configuration of the carton bottom panel 22. Four generally tubular support blocks, including two long blocks 124, 126 (depicted in FIG. 13) and two short blocks 128, 130 (depicted in FIG. 12) support a flat curb plate 132 parallel to and above the base 122. In the preferred embodiment, the blocks 124, 126, 128 and 130 are arranged in a generally square configuration with the blocks 124 and 126 being spaced from one another and generally parallel to form one of the opposing sides of the configuration and the blocks 128 and 130 being spaced from one another and generally parallel to form the other of the opposing sides of the configuration. Each of the blocks 124 and 126 is generally perpendicular to each of the blocks 128 and 130.

Each of the blocks 124 and 126 include inner carton forming surface 131 (FIGS. 11 and 13), and each of the blocks 128 and 130 include an inner carton forming surface 133 (FIGS. 11 and 12). As illustrated best in FIGS. 12 and 13, the package forming surfaces 131 and 133 extend upwardly from, and at generally right angles to the carton support surface 123. Preferably, the height of the surfaces 131, 133 (measured by the distance such walls extend above the surface 123) should be greater than about one fourth the height of the finished package defined by the length of the fold lines 48, 50, 52 and 54 (FIG. 1) and less than about three fourths of such height. In the preferred embodiment, each of the carton forming surfaces 131 and 133 extend substantially the entire length of the square configuration defined by the blocks 124, 126, 128 and 130.

In the preferred embodiment, the long blocks 124, 126 extend substantially across the entire base 122 such that its ends 137 extend to the outer edges of the base 122 and the curb plate 132 as illustrated best in FIG. 12. In contrast, as shown in FIG. 13, the blocks 128 and 130 have ends 135 which are spaced inwardly from the carton forming surfaces 131 of the blocks 124 and 126. Accordingly, the blocks 128 and 130 form a slot 162 between their ends 135 and the package forming surface 131. The preferred embodiment illustrates the carton forming walls 131 of the tubes 124 and 126 as extending across the entirety of the base 122 from one edge to the other; however, the advantage of the invention can be achieved as long as the surface 131 is sufficiently long to perform its carton forming function. The same is true for the carton forming surfaces 133, except for the provision of the slots 162. It is contemplated, however, that the surfaces 133 could be shorter provided they are sufficiently long to perform their carton forming function. In any event, since the ends of the blocks 128 and 130 define the slot 162, they must not extend beyond the surfaces 131.

The fixture 120 further includes two pairs of opposed, angled blocks including a first pair of opposed angled blocks 136, 138 supported by the blocks 128 and 130 and a second pair of angled blocks 140, 142 supported by the blocks 124, 126. All of the blocks 136, 138, 140, 142 may be substantially hollow, as are the support tubes 124–130, or may be formed as relatively thin, solid pieces of appropriate material, or filled with appropriate material.

Figure 3:
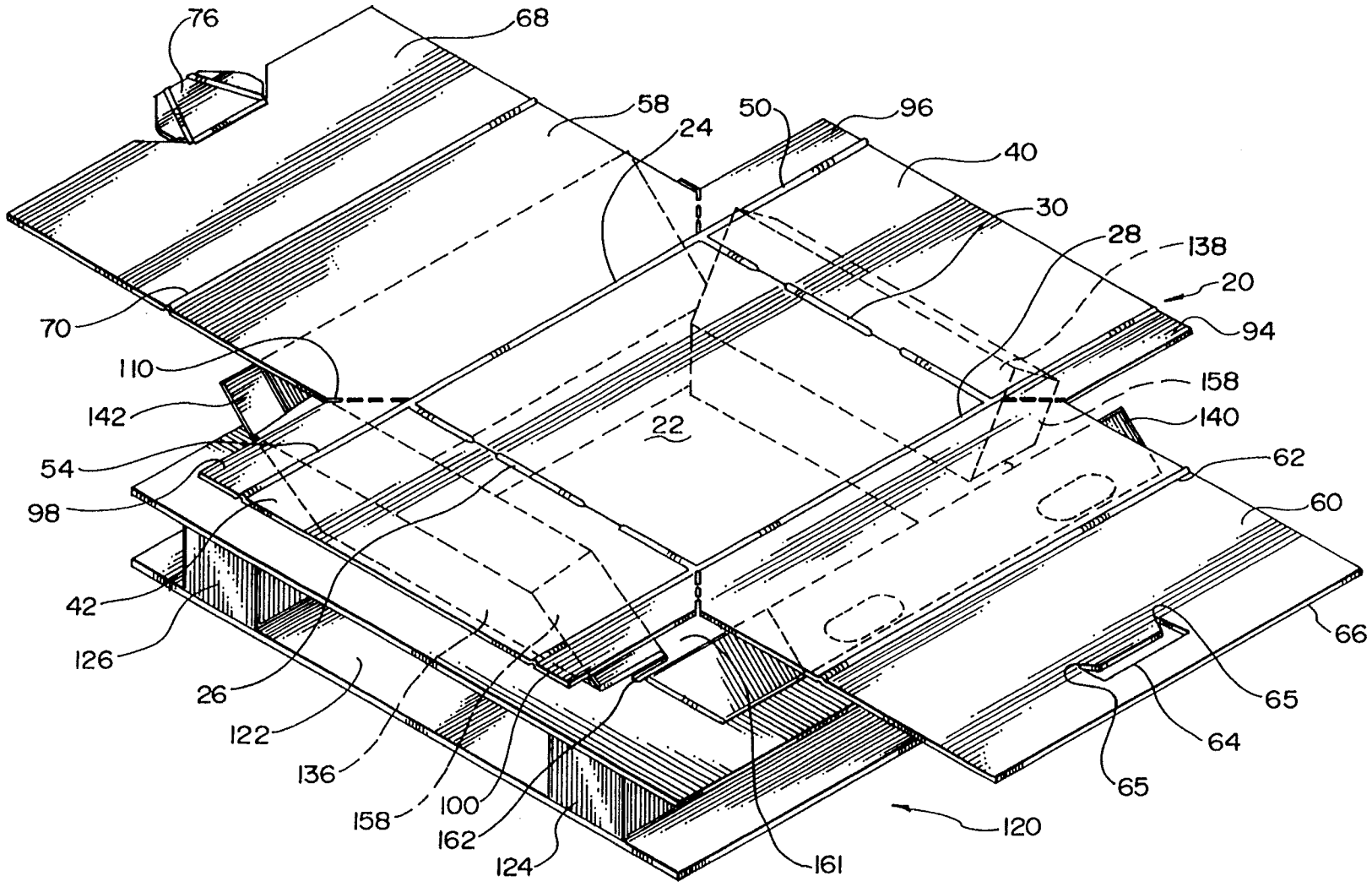
FIG. 3 is a perspective view of the forming fixture apparatus of the present invention, and also depicts an initial step in erecting the carton of the present invention.

Referring to FIG. 13, each of the opposed angled blocks 140, 142 include an angled package forming surface 144, 146, respectively, angled at approximately a 45° angle with respect to the base 122. Referring to FIGS. 11 and 12, each of the angled blocks 140, 142 include end or side edges 150. Referring to FIG. 12, each of the opposed angled blocks 136, 138 include an angled package surface 154, 156, respectively, and, referring to FIGS. 11 and 13, side or end walls 158. The forming faces 154, 156 form an angle of approximately 60° with respect to the base 122. The blocks 124–130, and specifically their respective package forming surfaces 131, 133, form a carton bottom receiving cavity, indicated generally at 161 (FIG. 3). Similar to the blocks 128, 130, the ends 158 of the angled blocks 136, 138 are spaced inwardly from the surface 133 to accommodate the slot 162. The curb plate 132 is also provided with appropriate positioned recesses 164 to accommodate and help define the slots 162. A transition portion guide or edge 143 is formed between the carton forming surfaces 131 and their corresponding carton forming surfaces 144, 146 and between the carton forming surfaces 133 and their corresponding carton forming surfaces 154, 156. Specifically, the guide edge is formed between the surface 131 and the surfaces 144, 146 and the guide edge is formed between the surface 133 and the surfaces 154, 156.

Figure 18:
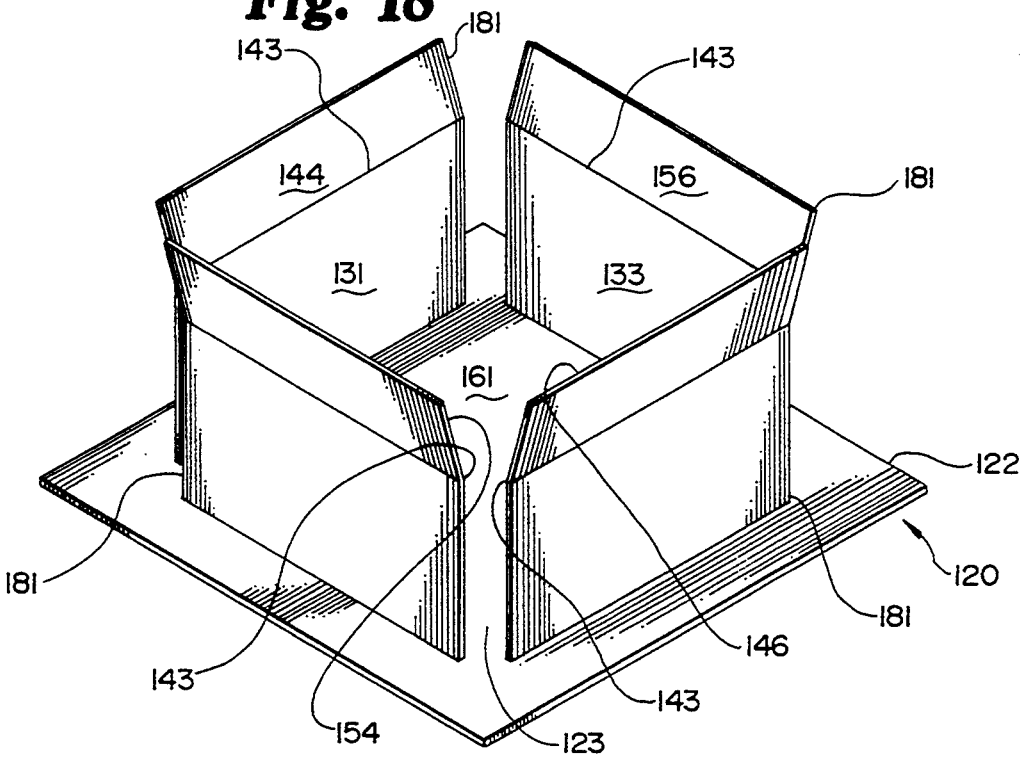
FIG. 18 is a pictorial view of a likely commercial embodiment of the fixture of the present invention.

The forming fixture 120 may be made of suitably rigid material including plastics, metals, and/or metal alloys. A preferred material for making the forming fixture 120 of the present invention is stainless steel. FIG. 18 depicts a likely commercial embodiment of the fixture 120 wherein the carton forming surfaces 131, 133 and 144, 146, 154, 156, and the base 122, are provided by four single pieces 181 of a single thickness or layer of suitable material approximately 1/16 of an inch thick. The pieces 181 are connected to the base 122 by conventional means. Adjacent pieces are spaced from one another at their edges.

The fixture structure can also be characterized as having a carton support surface 123, a first guide edge comprised of the edge portions 141, 143 and a second guide edge defined by the outer edge portions of the surfaces 144, 146 and 154, 156. As illustrated best in FIGS. 12 and 13, the first guide edge is spaced above and extends generally parallel to the support surface 123. Preferably the first edge defines a configuration approximating the size and configuration of the bottom wall of the carton. The second guide edge is spaced above and outwardly from the first guide edge. Each of the first guide edge portions and each of the second guide edge portions are spaced from adjacent first and second guide edge portions to accommodate the backfold web of the formed carton. Further, two of the opposed second edge portions are positioned so that they engage the carton being formed prior to the other opposed second guide edges. This causes two of the carton sides to be folded inwardly prior to the other.

Figure 2:
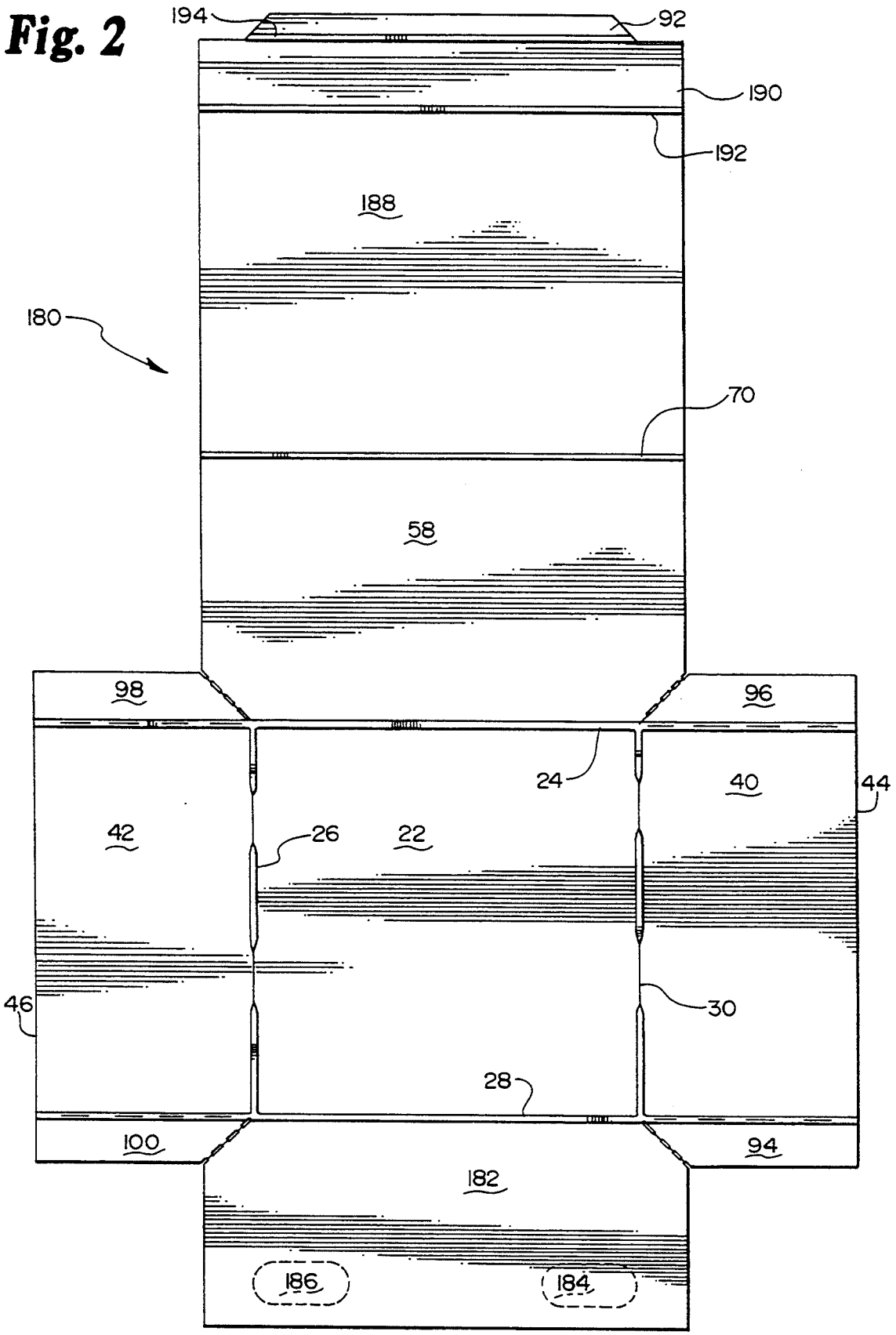
FIG. 2 is a top plan view depicting a second embodiment of the die-cut blank.

Referring to FIG. 2, a second embodiment blank 180 is depicted. The blank 180 for forming the second embodiment of the carton of the present invention is substantially similar to the blank 20 depicted in FIG. 1, and the similar features and structure thereof are identified with reference numerals in common with the blank 20 depicted in FIG. 1. Additionally, the blank 180 includes a side wall panel 182 (comparable and corresponding to side wall panel 56 of FIG. 1) foldably connected to the bottom panel 22 along the foldline 28. The side wall panel 182 includes adhesive areas 184, 186. The blank 180 also includes a single cover wall panel 188, conforming in shape to the bottom wall panel 22 and foldably connected to the side wall panel 58 along foldline 70. A glue panel 190 is foldably connected to the cover panel 188 along a fold scoreline 194. A pull tab 192 is foldably coupled to the glue panel 190 at the foldline 194. The pull tab 192 extends for part of the length of the panel 190.

With reference to FIGS. 3–6, the use of the forming fixture 120 of the present invention, in combination with blank 20, at the point of use is depicted. The forming fixture 120 may be placed permanently or movably on a suitable surface such as a countertop, tabletop or other suitable location in a restaurant. Referring to FIG. 3, initially the blank 20 is superimposed above the receiving cavity 161 of the forming fixture 120 with the bottom panel 22 generally aligned with the carton support surface 123. The side walls 40, 42 of the blank 20 including the backfolding support web panels 94, 96, 98, 100 are positioned over the 60° forming walls 136, 138. The two remaining side wall panels 56 are positioned over the 45° forming walls 140, 142.

Figure 4:
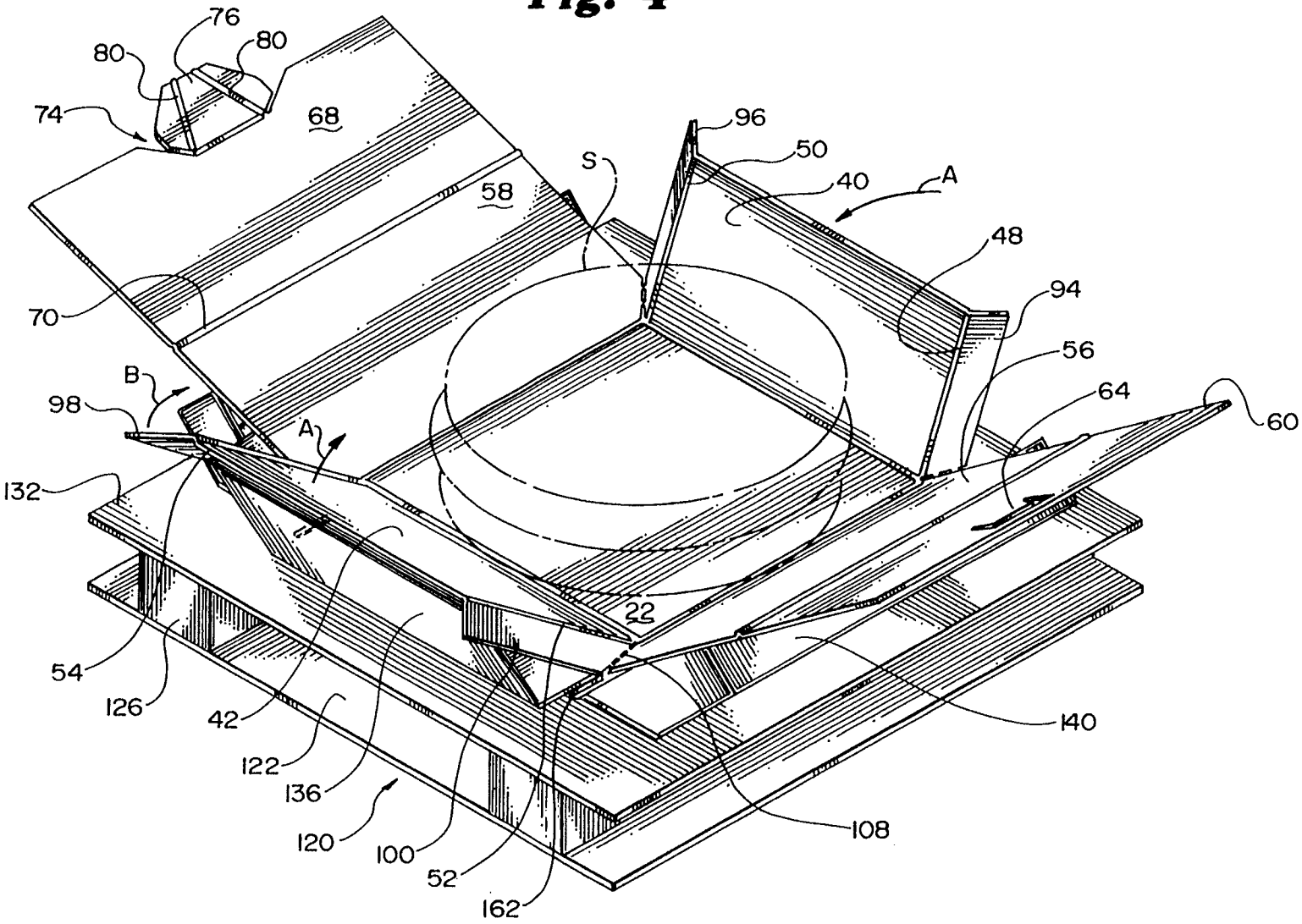
FIG. 4 is a perspective view depicting another step in erecting the carton, also depicting a food item in phantom.
Figure 6:
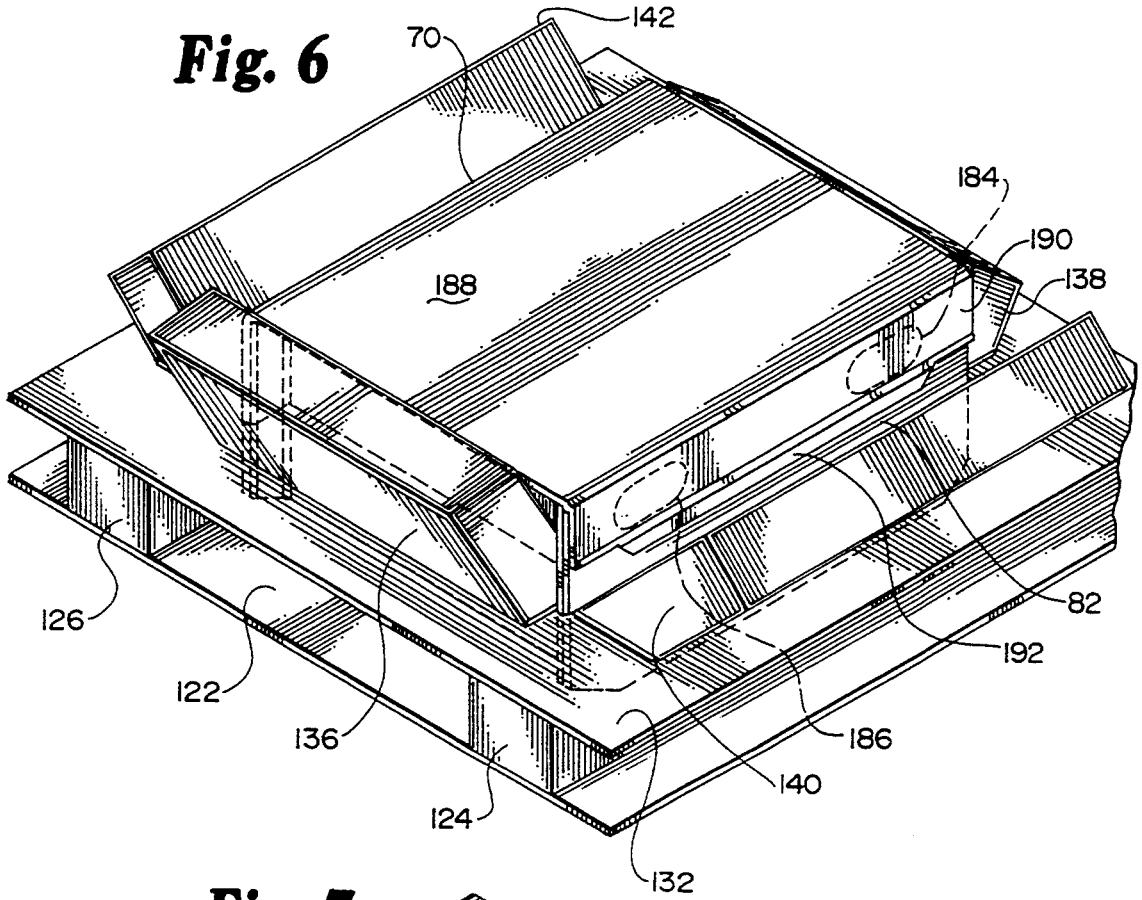
FIG. 6 is a perspective view depicting the second embodiment of the carton fully erected, filled and closed and prior to removal from the fixture

Referring to FIG. 4, a sandwich S, depicted in phantom, is placed on the bottom panel 22. The weight of the sandwich S will begin to move or force the bottom panel 22 downwardly into the bottom receiving cavity 161 of the forming fixture 120. Because the side wall panels 40, 42 with the backfolding web support panels 94, 96, 98, 100 are positioned over the 60° forming walls 136, 138, they will begin to fold upwardly in the direction of arrow A before the other two side wall panels 56, 58. Simultaneously, the backfolding web support panels 94, 96, 98, 100 begin to fold outwardly along foldlines 48–54 and along the angled cut foldlines 106, 108. As downward pressure into the cavity 161 is continued, the remaining side wall panels 56, 58 to which the cover panels 68, 60, are attached, begin to move upwardly and inwardly in the direction of arrow B, and the webs 202, comprised of the web panels 94, 96, 98, 100 and part of the side walls 56, 58, are received in the slots 162.

Figure 5:
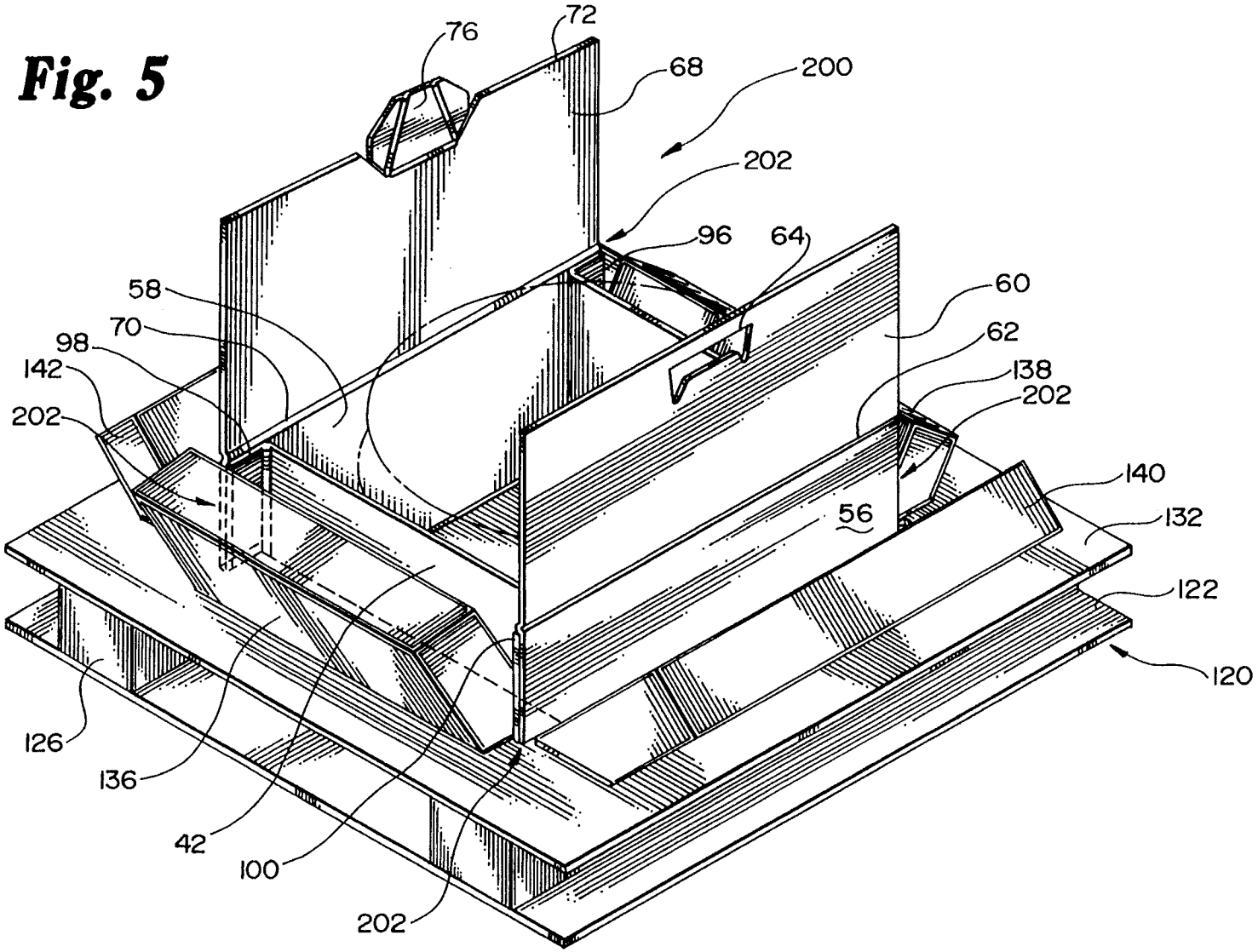
FIG. 5 is a perspective view depicting the carton side walls fully erected, but with the top open.

Referring to FIG. 5, when the bottom panel 22 of the now partially erected carton 200 contacts the support surface 123 of the forming fixture 120, the side wall panels 40, 42, 56, 58 will be perpendicular to the bottom wall 22. The backfolding web support panels 94–100 are completely backfolded to form a double thickness corner web 202 at each corner of the carton 200. The webs 202 are comprised of the web support panels 94–100 and the side wall panels 56, 58. The webs 202 are generally coplanar with the side walls 56, 58 and are generally perpendicular with respect to the other two opposed parallel side walls 40, 42 of the carton 200. The webs 202 are received in the slots 162 of the forming fixture 120.

Figure 8:
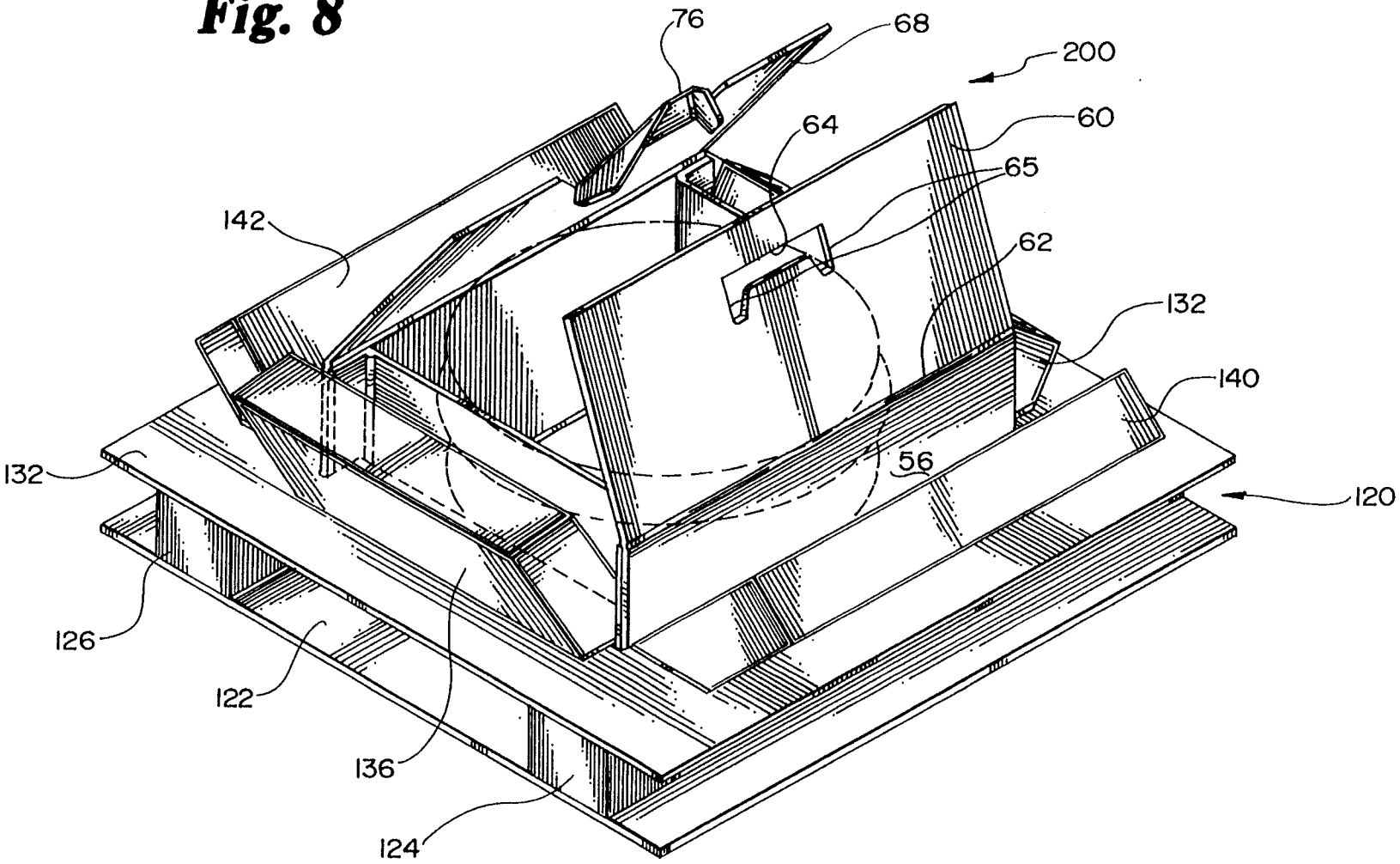
FIG. 8 is a perspective view depicting the die-cut blank of FIG. 1 in the forming fixture and ready to be locked.
Figure 9:
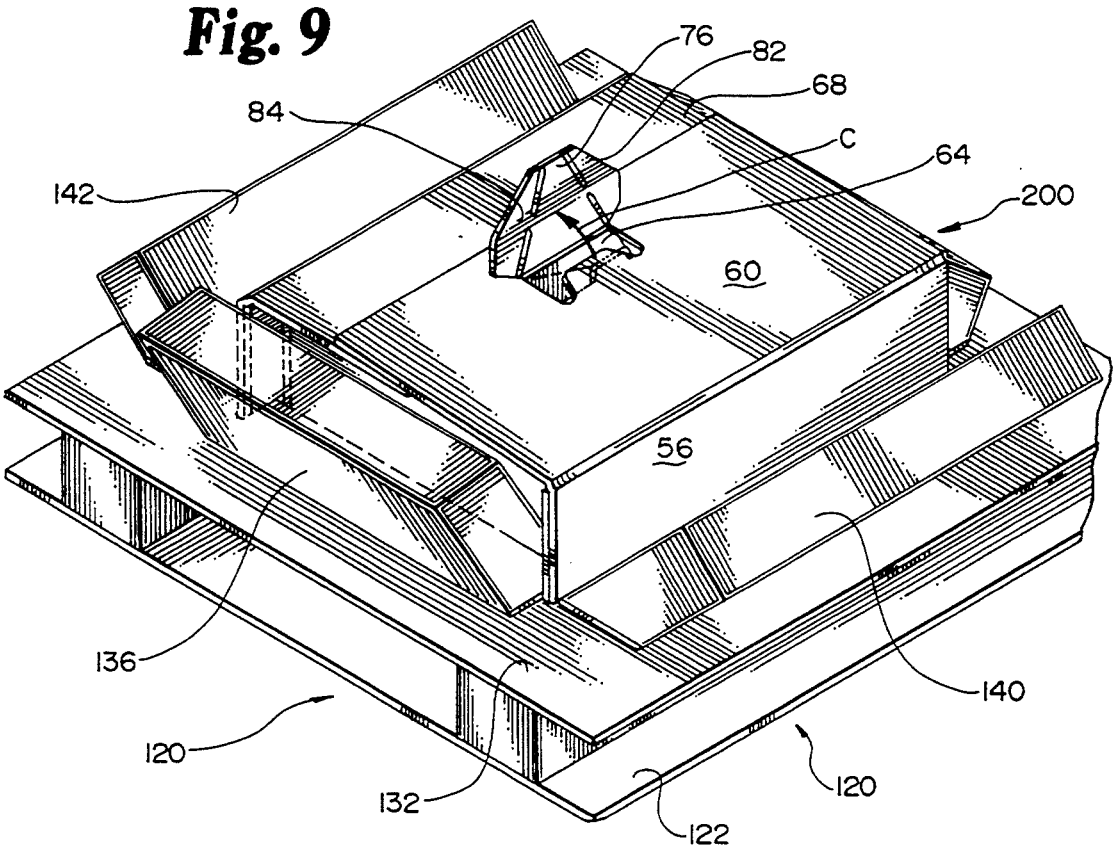
FIG. 9 is a perspective view thereof depicting an initial step in locking the carton.
Figure 10:
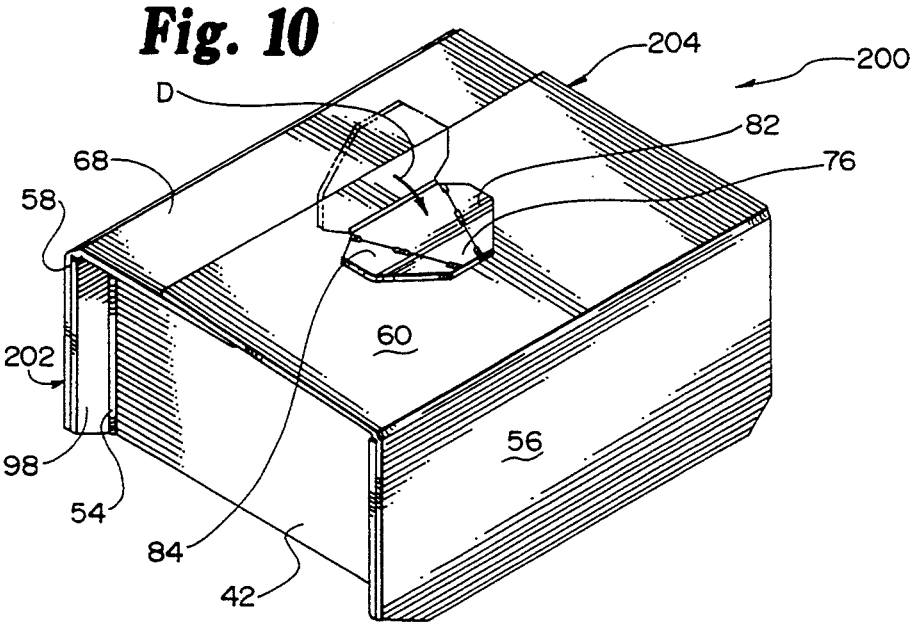
FIG. 10 is a perspective view depicting the final step in locking the carton.

Referring to FIGS. 8–10, the closing of the erected carton 200 formed from blank 20 is depicted. Specifically, referring to FIG. 8, the inside cover forming panel 68 and the outside cover forming panel 60 are folded downwardly toward the contents of the carton 200. Referring to FIG. 9, as the panels 68, 60 approach a coplanar relationship across the previously open top of the carton 200, the closure tab 76 may be inserted into the tab receiving opening 64. The closure tab 76 is raised in the direction of arrow C, thereby allowing the wings 82, 84 to extend out beyond the edges of the opening 64 on both sides thereof. Referring to FIG. 10, the tab 76 can then be folded downwardly along arrow D to lie generally parallel and closely adjacent the top wall, indicated generally at 204, of the now dosed and locked carton 200.

Figure 16:
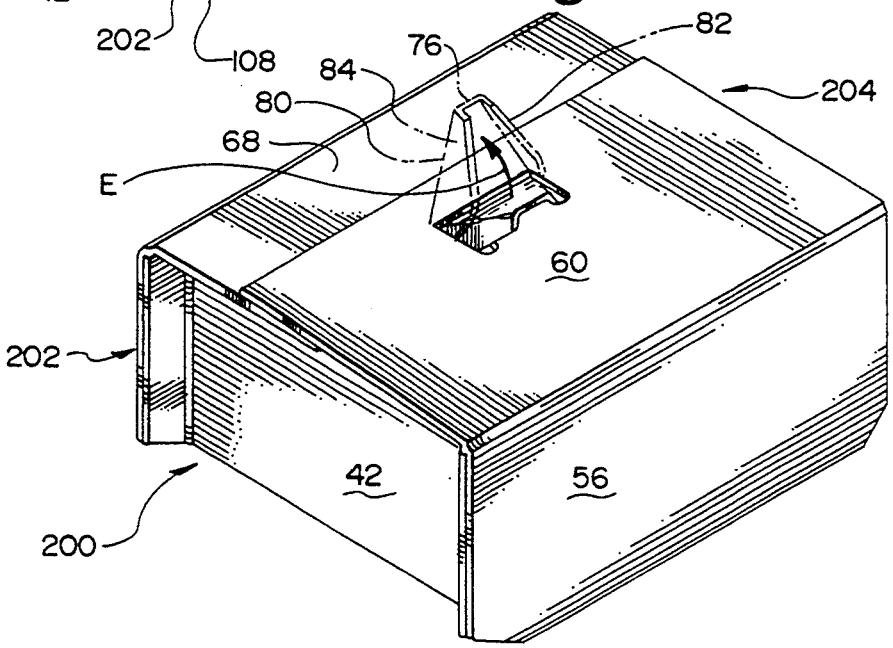
FIG. 16 is a perspective view depicting an initial step in the opening of the carton formed from the blank depicted in FIG. 1.
Figure 17:
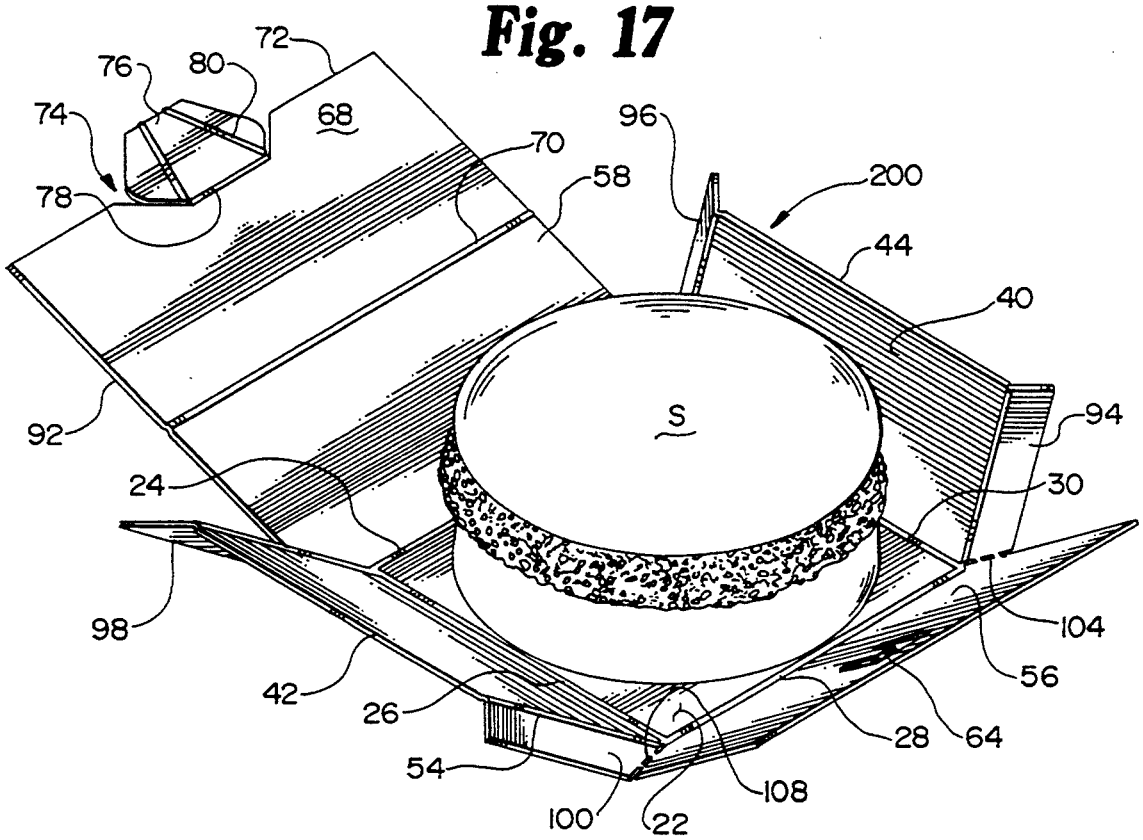
FIG. 17 is a perspective view of a fully opened carton.

Referring to FIG. 16, to open the carton 200, the tab 76 is first lifted in the direction of arrow E. The wings 82, 84 are folded about the foldlines 80 toward each other, until they overlie the expanded ends 65 of the opening 64. The outer cover forming panel 60 is raised until the tab 76 passes through the opening 64. Referring to FIG. 17, the side walls 40, 42, 56, 58 may be folded downwardly about the foldlines 24–30 allowing complete access to the sandwiches contained in the now opened carton 200.

Figure 7:
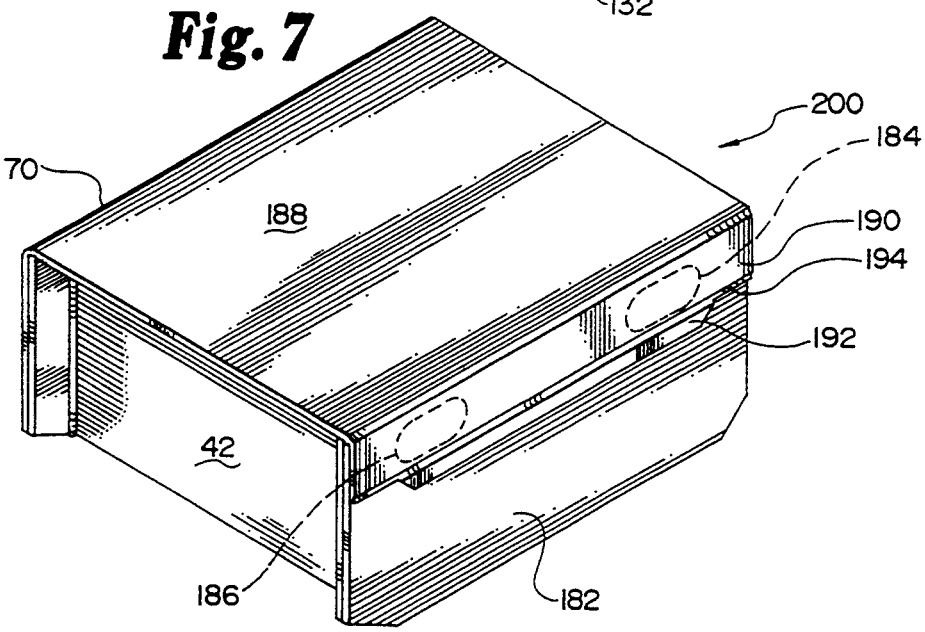
FIG. 7 is a perspective view of a fully erected, filled and dosed carton removed from the fixture.
Figure 14:
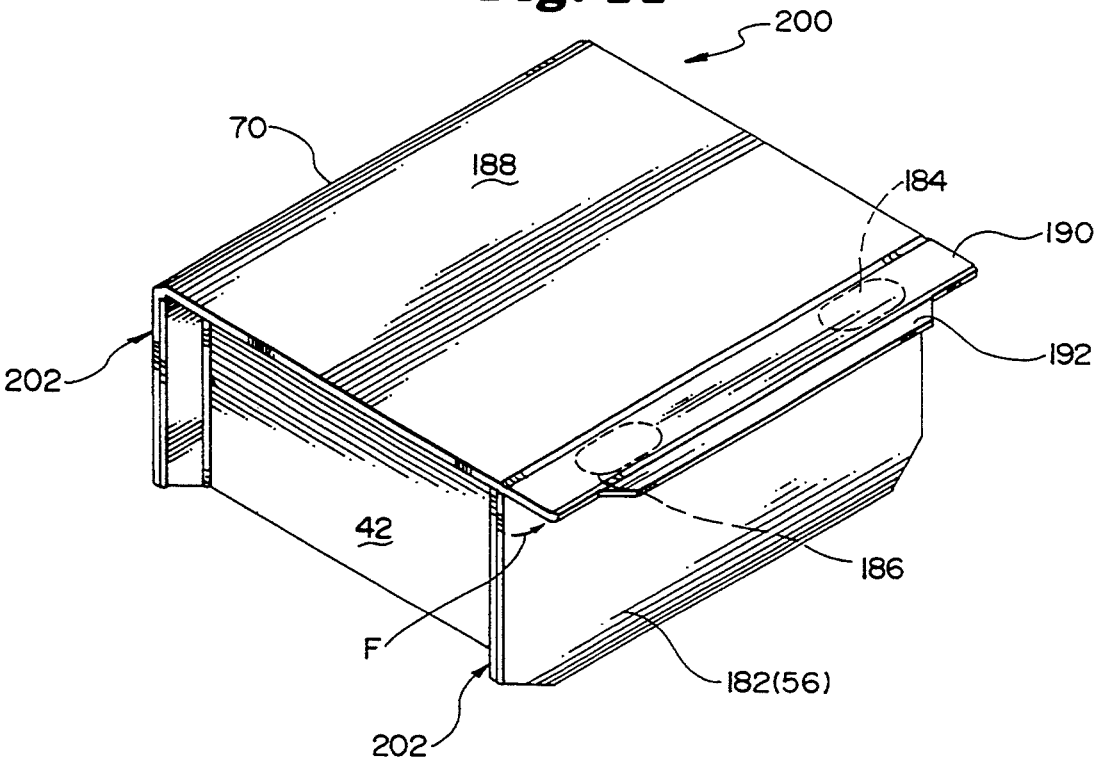
FIG. 14 is a perspective view depicting an initial step in the opening of the carton formed from the blank depicted in FIG. 2.
Figure 15:
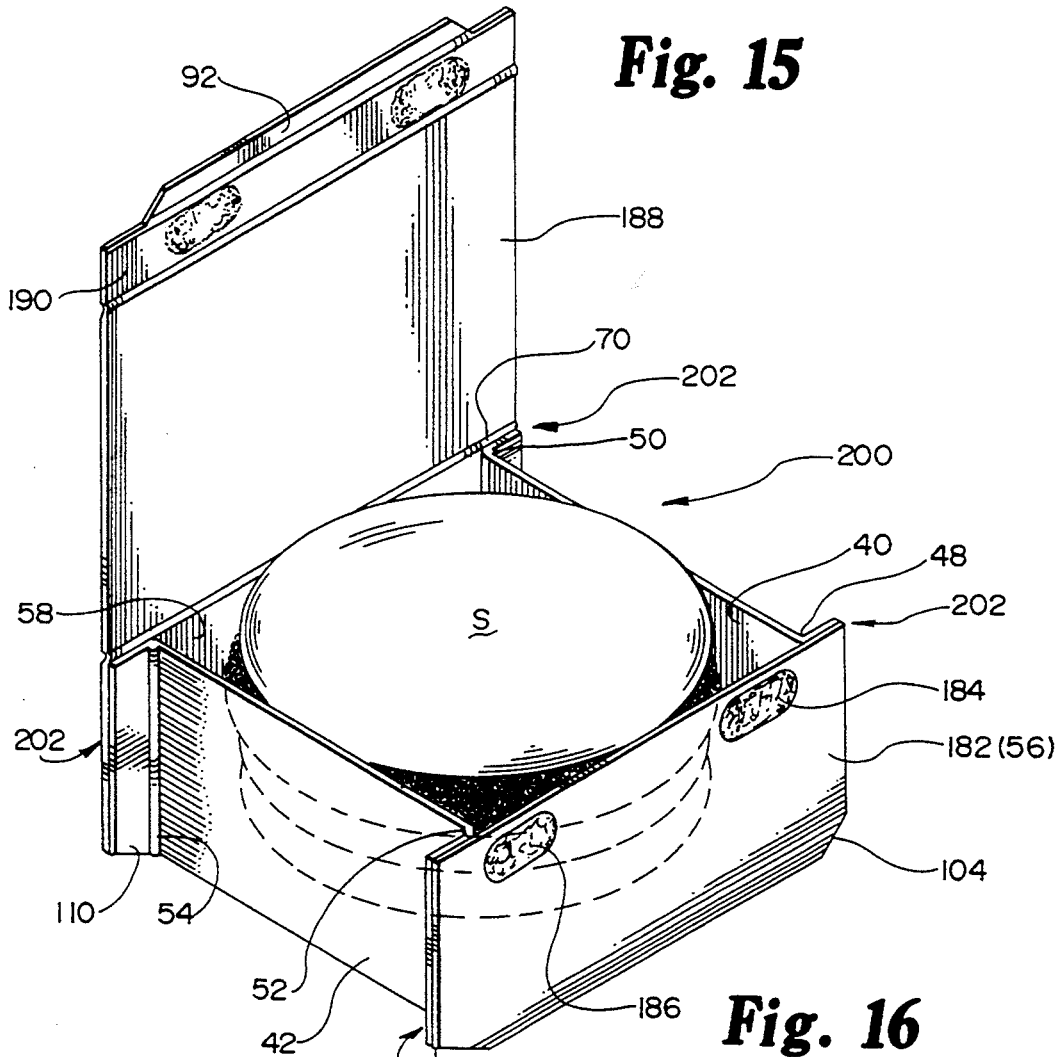
FIG. 15 is a perspective view of the opened carton and the contents therein.

With specific regard to opening the carton 200 formed from the blank 180, referring to FIGS. 7, 14, and 15, depicting a filled and dosed carton, the pull tab 192 is pulled outwardly in the direction of arrow F rupturing the adhesive attachment between the glue panel 190 and side wall 182, and the adhesive areas 184, 186. The top cover panel 188 may then be rotated upwardly around the foldline 70 and the carton 200 can be unfolded to the position depicted in FIG. 15. The fully opened carton 200, formed from either blank 20, 180, will be substantially as illustrated in FIG. 17.

One of the advantages of the carton 200 of the present invention may be appreciated by reference to FIG. 15. The backfold webs 202 are connected to the side walls 182, 58 along angled perforated foldlines 104–110, and to side wall panels 40, 42 along foldlines 48, 50 and 52, 54, respectively. Consequently, even if a relatively heavy sandwich, such as a hamburger, is contained in the carton 200, rough handling of the carton 200 will not cause the side walls 40, 42, 182, 58 of the carton 200 to move outwardly. Another advantage of this backfolded web structure 202 is that the corners of the carton 200 are substantially dosed, thereby preventing cooling and contamination. Yet another advantage of the carton 200 is depicted in FIG. 17, wherein the carton 200 is unfolded to lie substantially flat for supporting the food item while it is being consumed.

The second embodiment blank 180 of the present invention may be partially glued or tubed into a generally hollow, cylindrical, tubular configuration (not shown) by the manufacturer. For example, in the second embodiment blank 180, the adhesive areas 184, 186 would be activated or adhesive would be applied at the point of manufacture and the carton 200 would be shipped in a generally flattened, tube-like form. At the point of use the carton 200 would be erected to form an open-ended tube and a sandwich would be inserted in one of the two open ends, which could then be closed either by pushing them inwardly by hand or by placing the filled carton 200 in the fixture 120, aligning the backfold webs 202 with the slots 162 and pushing the carton 200 into the fixture 120 whereby the side walls 40, 42 would fold dosed as they come in contact with the 60° angle forming walls 136, 138, closing the carton 200 into the shape depicted in FIGS. 6 and 7.

A number of variations of the present invention can be accomplished within the scope of the invention. For example, the location, size and shape of the cover locking structure associated with the blank 20 (or 180) may be varied as desired. The carton 200 can be adapted to contain products of various sizes and shapes. Portions of the carton 200 may be curved rather than angled and the depicted fold scorelines may be perforated or cut as desired. The carton 200 may be formed of any appropriate caliper paperboard or other stock material, be printed with desired graphics or indicia, and may be provided with desireable characteristics such as resistance to moisture by applying appropriate coatings to the interior or exterior surfaces.

Although a description of the preferred embodiment has been presented, it is contemplated that various changes, including those mentioned above, could be made without deviating from the spirit of the present invention. It is therefore desired that the present embodiment be considered in all respects as illustrative, not restrictive, and that reference be made to the appended claims rather than to the foregoing description to indicate the scope of the invention.

What is claimed is:

1. A generally polygonal carton comprising:

a polygonal bottom wall having at least a pair of adjacent edges and a corner between said pair of adjacent edges;

a side wall foldably attached to each of said adjacent edges, said side walls arranged in two sets of opposed side walls, each side wall having side edges and an upper edge extending between said side edges;

corner means foldably connected to the carton generally between adjacent side walls at each corner of the bottom wall for substantially closing the corners of the carton and comprising web panels, each being foldably connected to the side edges of the side walls of one of said two sets of opposed side walls and to the side walls of the other set of opposed side walls along a fold line extending outwardly at an angle from each corner of the bottom wall;

top closure means for closing the top of said carton comprising an underlying top closure panel foldably connected along the upper edge of one of said opposed side walls and an overlying top closure panel foldably connected along the upper edge of the opposite side wall; and locking means for releasably locking the top closure means.

2. The carton according to claim 1, wherein said locking means comprises a closure tab carried by said underlying top closure panel and a tab receiving opening in said overlying top closure panel.

3. The carton of claim 2 wherein said closure tab includes a tab center defined by a pair of angular closure fold scorelines, a free edge and a connection fold scoreline, and a pair of closure wings connected to said tab center along said closure scorelines.

4. The carton of claim 3 wherein the tab center is foldably connected with said underlying top closure panel along the connection fold scoreline.

5. The carton of claim 3 wherein said tab center has a minimum width dimension at its free end and each of said wings has a maximum width dimension extending in a direction perpendicular to its respective angular closure fold scoreline and said tab receiving opening has a length dimension measured along a line parallel to, and at least as long as, said connection fold scoreline and at least one width dimension at least as long as said maximum width dimension.

6. The carton of claim 5 wherein said tab receiving opening has a pair of ends each having a width dimension at least as long as said maximum width dimension.

7. A single-piece blank for forming a carton, said blank comprising;

a polygonal bottom wall panel having at least a pair of adjacent edges and a corner between adjacent edges;

a side wall panel foldably attached to each of said adjacent edges of the bottom wall panel, said side wall panels having side edges and being arranged in at least two sets of opposed side wall panels;

corner means for substantially closing the corners of the carton formed when the blank is erected, said corner means comprising web panels foldably connected to each side edge of the side wall panels of one set of opposed side wall panels and to the side wall panels of the other set of opposed side wall panels along an angular fold line extending outwardly from each corner of said bottom panel; and top closure means for closing the carton formed when said blank is erected, said top closure means comprising a first top closure panel foldably connected to one of said side wall panels and having a free edge and a second top closure panel foldably connected to the side wall panel opposite to the side wall panel carrying said first top closure panel.

8. The blank according to claim 7 and locking means for releasably connecting said first and second top closure panels.

9. The blank according to claim 8, wherein said locking means comprises a tab carried by said first top closure panel along said free edge and a tab receiving opening in said second top closure panel.

10. A carton for temporarily containing and protecting fast food items, wherein the carton can be converted simply and easily into a substantially planar tray for supporting the contents during consumption, comprising:

a polygonal bottom wall having a periphery defined by bottom edges, each having a pair of ends and each intersecting an adjacent edge at each of its ends to define a corner of the bottom wall;

a first and second pair of opposed side walls foldably attached to a portion of the periphery of the bottom wall, each side wall of the first pair having two opposed side edges substantially perpendicular to the portion of the periphery of the bottom wall at which the side walls of the first pair are attached and substantially collinear with the portion of the bottom wall periphery at which the side walls of the second pair are attached;

a single web panel at each corner of the bottom wall, each being foldably connected to one of the side edges of the side walls of the first pair of opposed side walls and foldably connected to the side walls of the second pair of side walls along a fold line extending at an angle diagonally outwardly from each corner of said bottom panel; and top closure means for closing the top of said carton comprising a first top closure panel foldably connected to one of the side walls of the second pair and having a free edge, and a second top closure panel foldably connected to the side wall panel opposite to the other side wall of the second pair, said first top closure panel carrying a closure tab and said second top closure panel carrying a closure tab receiving opening.

11. The carton according to claim 10, wherein said closure tab includes a tab center defined by a pair of angular closure fold scorelines, a free edge and a connection fold scoreline, a pair of closure wings being connected to said tab center along said closure scorelines, the closure tab being foldably connected to the free edge of the first top closure panel along the connection fold scoreline and having a minimum width dimension along its free edge, each of said wings having a maximum width dimension extending in a direction perpendicular to the associated angular closure fold scoreline, said tab receiving opening having a length dimension measured along a line parallel to, and at least as long as, said connection fold scoreline and at least one width dimension at least as long as the maximum width dimension of said wings.

12. A carton for temporarily containing and protecting fast food items, wherein the carton can be converted simply and easily into a substantially planar tray for supporting the contents during consumption, said carton comprising a bottom wall with a peripheral edge and corners, and pairs of adjacent side walls foldably connected to the bottom wall about the peripheral edge, each of said pairs of adjacent side walls including one side wall substantially free of fold lines and one side wall with web regions each defined by a fold line generally perpendicular to the peripheral edge, the side walls of each of said pairs of adjacent side walls being connected along a fold line extending diagonally outwardly from the corners of the bottom wall, the surface area of the side walls substantially free of fold lines being greater than the surface area of the side walls with the web regions less the surface area of the web regions, a first closure panel with a free edge foldably connected to one of the side walls substantially free of fold lines, and a second closure panel foldably connected to an opposed another one of the side wall panels substantially free of fold lines, said first closure panel carrying a closure tab and said second closure panel carrying a closure tab receiving opening.

13. The carton according to claim 12, wherein said closure tab includes a tab center defined by a pair of angular closure fold scorelines, a free edge and a connection fold scoreline, a pair of closure wings being connected to said tab center along said closure scorelines, the closure tab being foldably connected to the free edge of the first closure panel along the connection fold scoreline and having a minimum width dimension along its free edge, each of said wings having a maximum width dimension extending in a direction perpendicular to the associated angular closure fold scoreline, said tab receiving opening having a length dimension measured along a line parallel to, and at least as long as, said connection fold scoreline and at least one width dimension at least as long as the maximum width dimension of said wings.

* * * * *